US005848650A

United States Patent [19]

Brady

[11] Patent Number: 5,848,650

[45] Date of Patent: Dec. 15, 1998

[54] VEHICULAR ENGINE COMBUSTION SUPPRESSION METHOD

[75] Inventor: Brian B. Brady, Seal Beach, Calif.

[73] Assignee: The Aerospace Corporation, El Segundo, Calif.

[21] Appl. No.: 873,571

[22] Filed: Jun. 12, 1997

[51] Int. Cl.[6] ..... B69B 1/08

[52] U.S. Cl. ..... 169/36; 89/1.11

[58] Field of Search ..... 169/62, 65, 36; 89/1.11

[56] References Cited

U.S. PATENT DOCUMENTS

| | | | |
|---|---|---|---|
| 2,873,806 | 2/1959 | Bittner | 169/36 |
| 4,505,336 | 3/1985 | Thevis et al. | 169/85 |
| 4,696,347 | 9/1987 | Stolov et al. | 169/36 |
| 4,776,255 | 10/1988 | Smith | 89/1.11 |
| 4,986,365 | 1/1991 | Shieh | 169/62 |
| 5,154,238 | 10/1992 | Buchan | 169/62 |
| 5,194,687 | 3/1993 | Garfinkle | 89/1.11 |
| 5,444,102 | 8/1995 | Nimitz et al. | 521/131 |
| 5,501,284 | 3/1996 | Clodfelter et al. | 169/54 |

FOREIGN PATENT DOCUMENTS

| | | | |
|---|---|---|---|
| 1129098 | 5/1962 | Germany | 89/1.11 |
| 2551668 | 6/1977 | Germany | 89/1.11 |

OTHER PUBLICATIONS

*National Defense* May/Jun. 1994 "Non–lethal Alternatives Weighed by Law Officers" Paul R. Evancoe.

Barrier Element Final technical report by Chrysler Corporation, Defense Division, Detroit Michigan contract No. DAAE07–74–C–0217 Jul. 1973.

*Primary Examiner*—Kevin Weldon

*Attorney, Agent, or Firm*—Derrick Michael Reid

[57] ABSTRACT

A trifluoroidomethane mixture with an inert atmospheric buoyant gas such as helium form a fire suppressant gas that is used to stop the combustion of internal combustion engines of motor vehicles to stop the motor vehicles. The gas is contained for delivery to the motor vehicle. The suppressant gas can be used by law enforcement agencies to stop fleeing motor vehicles. The gas can be contained in a shell for dropping from freeway overpasses and helicopters. The gas can be dispersed from road side nozzles to stop fleeing vehicles, such as those running border, ports and custom facilities during unlawful smuggling.

2 Claims, 2 Drawing Sheets

Fixed Site Deployment

Fixed Site Deployment

Overhead Deployment

VEHICULAR ENGINE COMBUSTION SUPPRESSION METHOD

STATEMENT OF GOVERNMENT INTEREST

The invention was made with Government support under Contract No. F04701-93-C-0094 by the Department of the Air Force. The Government has certain rights in the invention. The invention described herein may be manufactured and used by and for the government of the United States for governmental purpose without payment of royalty therefor.

FIELD OF THE INVENTION

The invention relates to the field of fire suppression. More particularly, the present invention relates to fire retardants for exterminating the combustion for motor vehicles especially for use by law enforcement.

BACKGROUND OF THE INVENTION

Fire departments have long used Halon based fire retardants to put out fires. Halon fire retardant is usually sprayed on an existing fire. Halon gas removes heat from the fire, retarding further combustion of the fire. For example, fire department personnel arriving at the scene of a burning vehicle, spray a halon retardant gas upon the vehicle to put out the fire. While it is known that Halon retardants can stop fire combustion, Halon retardants have disadvantageously not been applied to deter the internal intended combustion of motor vehicles, because the Halon gas has long been used to put out fires.

In high speed pursuit by law enforcement often results in personal injury and property damage. Often, law enforcement officers will pursue in motor vehicle suspects for a considerable amount of time while subjecting the suspects, officer and bystanders to potential risk of injury and property damage during high speed pursuits. There exists a need to stop a motor vehicle operated by fleeing suspects to prevent personal injury and property damage while providing the officers an opportunity to catch the fleeing suspects preventing the suspects' escape. Current methods of stopping fleeing vehicles such as tire spikes, electromagnetic pulsars and or eventual fuel depletion are disadvantageously applied. Tire spikes cause damage to the tires and may lead to additional property damage by an uncontrollable vehicle in hot pursuit. The tire spikes and electromagnetic pulsars disadvantageously require advance positioning in front of the fleeing motor vehicles and spike and pulsars are not be suitable in most hot pursuits. Fuel depletion often requires a lengthy hot pursuit during which persons and property are subject to possible injury and damage during the hot pursuit. These and other disadvantages are solved or reduced using the invention.

SUMMARY OF THE INVENTION

An object of the invention is to provide a combustion retardant substance which will disable a motor vehicle.

Another object of the invention is to provide a Halon combustion retardant that will disperse around a moving motor vehicle.

Yet another object of the invention is to deliver a Halon combustion retardant around a moving motor vehicle to stop the combustion of the motor vehicle to stop the movement of the motor vehicle.

Still another object of the invention is to provide a fire suppressant delivery device to safely halt a fleeing motor vehicle.

A Halon based fire suppressant is used to stop a motor vehicle. The halon retardant is a halon containing gas that siphons off heat to prevent continued combustion. Halon containing gas includes gas containing saturated halocarbons, halogenated ketones, halogenated anhydrides, halogenated esters, unsaturated halocarbons, halogenated ethers, among others. Halon mixtures are particularly well suited for stopping the combustion of the motor vehicles. The Halon mixtures are mass effective, non-toxic, and non-corrosive. Halon mixtures can be used which do not destroy the stratospheric ozone. Each of the possible halon retardants have varying amounts of mass effectiveness, toxicity and corrosiveness. The selected halon retardant gas depends upon the requirements of various possible law enforcement applications and considerations.

A preferred halon retardant is trifluoroidomethane. A pound of trifluoroidomethane appropriately deployed can stop the combustion of a motor vehicle, such as, two liter engine running at 3000 rpm, for twenty seconds sufficient to stop the vehicle. The halon retardant can be deployed in a variety of ways. For example, the Halon retardant can be deployed by spraying the gas from fixed site installation into the road traveled by motor vehicles. Another exemplar deployment can be by way of a hand held canister for applying gas into a stopped vehicle for preventing the restarting and escape of the stopped vehicle. Another exemplar deployment can be the dropping of the gas shell from an elevated overhead position such as from an overhead helicopter or freeway overpass. Another exemplary deployment can be launching a gas cartridge as a projectile in front of a moving vehicle. These and other advantages will become more apparent from the following detailed description of the preferred embodiment.

DETAILED DESCRIPTION OF THE PREFERRED EMBODIMENT

Figure 1:
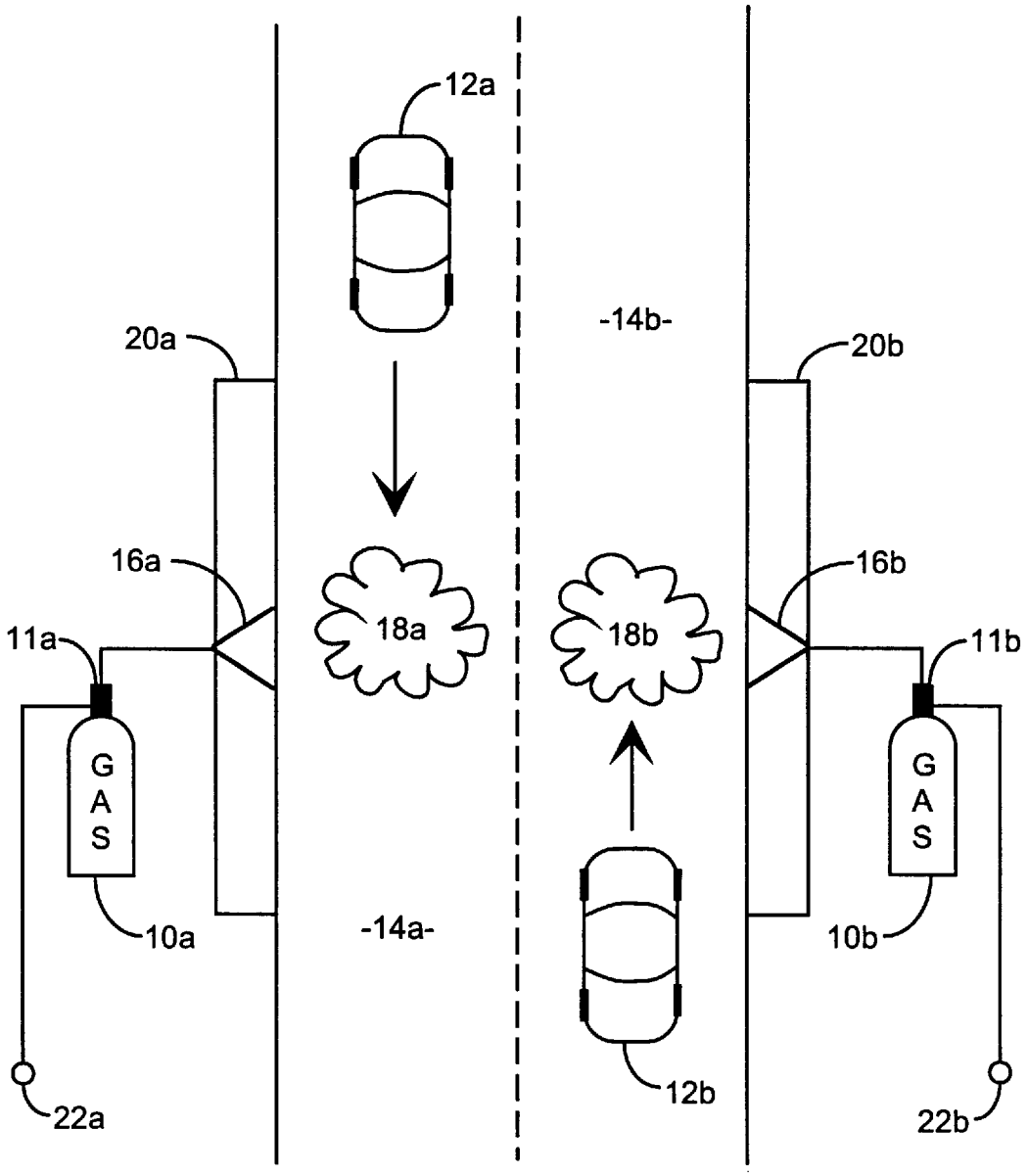
FIG. 1 is a diagram depicting fixed site deployment.

An embodiment of the invention is described with reference to the figures using reference designations as shown in the figures. Referring to FIG. 1, a halon retardant gas from gas supplies 10*a* and 10*b* can be used to stop motor vehicles 12*a* and 12*b*, respectively, such as cars, when moving along a street lanes 14*a* and 14*b*. The halon gas 10*a* and 10*b* are released through tank actuated valves 11*a* and 11*b*, through respective nozzles 16*a* and 16*b* to create respective gas clouds 18*a* and 18*b*. The nozzles 16*a* and 16*b* can be mounted in road side barricades 20*a* and 20*b*, respectively. When a the vehicles 12 approach the barricades 20, the gas 10 is released through the nozzles 16 to create gas clouds 18 which stop the motor vehicles 12 when entering the clouds 18. External controls lines 22 can be activated by law enforcement officials to actuate the valves 11 to create the gas clouds 18.

In U.S. border and custom enforcement, fixed site deployment offers officers a means to stop smugglers and border runners attempting to illegally traverse the U.S. border. Border locations typically provide motor vehicles a set predetermined path to follow when crossing the borders. At major ports and border crossings, runners often attempt to evade U.S. official through high speed fleeing into the U.S. from the port and border posts. Fixed site locations on the U.S. side of a border or port facility at the exits can be used to stop a fleeing vehicle. The size of the cloud 18 can be controlled by an appropriate amount of gas at a predetermined pressure to create sufficiently sized cloud to cover the road 14 between barricades 16 to stop the vehicles 12. In the case of a preferred use during the one way exit from a border of port facility, the barricades 20 can be disposed opposite a one way road 14.

Most vehicles 12 take in air to support combustion from the space between the engine and hood. This air is replaced from air in an intake zone in front of the vehicle, through the grill, up to one meter above the road 14. When the cars exit path is restricted at to only one lane, for example, lane 14*b*, an intake zone of about one meter wide and one meter high. This intake zone can be flooded with fire suppressant by opposing nozzles 16*a* and 16*b* placed on each side of the lane 14*b*. A plurality of nozzles 16 can be placed at intervals to create the desired length of the cloud 18. For example, the twelve nozzles 16 can be places at half meter intervals on each side of the lane 14. Twelve opposing pairs of nozzles cover six meters of lane length. Hence, the size of the cloud 18 can be predetermined by design of a gas release system comprising the gas tanks with actuated values 10, nozzles 16 and lane barricades 20. The gas tanks 10 may contain, for example, six cubic meters of gas.

A mixture of 13% trifluoroidomethane and 87% helium would be neutrally buoyant in air for providing a neutrally buoyant plume cloud 18 that will disperse slowly and remain between the barricades 20 for a sufficient amount of the time for the vehicle 12 to enter the lane 14 and the cloud 18 and be stopped by terminated internal engine combustion. The trifluoroidomethane is in excess of a concentration to absorb heat necessary for combustion. The helium provides additional fire suppression, both removing heat and displacing oxygen, in the path of the moving car with an insignificant increase in cost. The trifluoroiodomethane is heavier than air. The helium adds buoyancy to the gas consistent with air for stable gas cloud formation. After the vehicle has been stopped by the gas cloud formation, the gas may be turned off by law enforcement using the lines 22.

Another type of gas deployment can be by way of manual spraying using a pressurized hand held canister. The canister would be a cylinder six inches in diameter and a foot and a half high. It would contain five lbs of trifluoroidomethane in a bladder made of AFE-332 or another suitable polymer. The canister would also contain a pressurant gas to compress the bladder and eject liquid trifluoroidomethane. A hose with a valve would be attached to the bladder in the canister to allow the liquid spray to be easily directed, and controlled from a trigger on the handle. A law enforcement official can prevent the starting of the stopped car by spraying the stopped car with the retardant liquid, which would quickly vaporize. A mobile law enforcement unit can be equipped with the pressurized canister. The mobile vehicular law enforcement unit having a hand held canister could approach the scene of a stopped vehicle. An officer could then apply the retardant to the stopped car to prevent the starting of the car to prevent the car and the occupants from leaving the scene. The canister is preferably held at a safe distance from the car, for example, seven meters away, and a liquid spray is aimed at the grill of the stopped car. The liquid may evaporate before reaching the vehicle, but the high density of trifluoroidomethane enables the gas to follow the path of the liquid.

Figure 2:
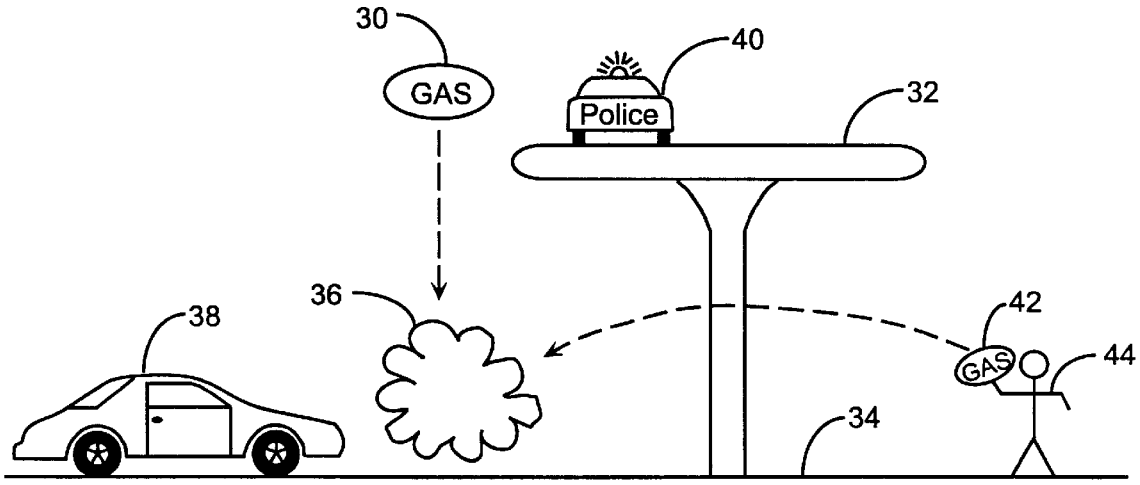
FIG. 2 is a diagram depicting overhead deployment.

Referring to FIG. 2, overhead deployment is an attractive option for most law enforcement agencies having mobile force deployment capabilities. A gas shell 30 is dropped from an elevated position, such as a freeway overpass 32, onto a road 34, to rupture upon impact to create a gas cloud 36 in the path of a moving vehicle 38. Another gas shell 42 may be lobbed by a law enforcement official 44 towards the moving vehicle 38 to create or sustain the gas cloud 36. A mobile law enforcement ground unit 40 could be dispatched to overpass 32 in advance of the fleeing vehicle 38 to drop the shell 30 in the path of the vehicle 38. Police helicopters could be used as well as the ground vehicle 38. Law enforcement mobile units, including vehicles and helicopter, can be rapidly dispatched to locate and capture fleeing vehicles. Using conventional radio commands, mobile law enforcement units can be directed to the location of a crime and or to the path of a fleeing suspect in a fleeing motor vehicle. Mobile units equipped with the shell 30 can then have a valuable tool to stop the fleeing vehicle.

Preferably, the gas is contained in the shell 30 and dropped from an elevated position. The shell 30 should easily rupture upon impact with ground in the path in front of a moving fleeing car. The shell 30 is preferably light in weight. Trifluoroidomethane is a mass effective suppressant gas. Trifluoroidomethane changes into a liquid state when slightly compressed for example, at 2.5 psig, at room temperature. One pound of this liquid could be confined in a thin polymer balloon, 200 cc or 7 oz in volume. This size shell is easily held in the hand. The shell 30 can be manufactured as a balloon filled with the gas and heat sealed. The gas condenses under modest elastic balloon pressure into a compact light weight liquid balloon shell that can be easily dropped from an over head position. The shell could also be used by mobile units traveling directly in front of the fleeing vehicle and dropped out of a side window. A one pound shell of liquid gas expands as a hemisphere gas cloud of approximately two meters in diameter in about ten seconds. A fleeing vehicle traveling at sixty mph would traverse the hemispherical gas cloud in 70 milliseconds, just long enough to suppress ignition for about three revolutions of the engine, enough to temporarily disable the car, and enable pursuit to catch the fleeing vehicles. Additional shells can be used to sustain the disabled vehicle in place until the suspects in the car are apprehended. The elastic polymer shell is one to two mils thick and is strong enough to enable the lobbing of the shell 42 by a law enforcement official 44 without rupturing the shell 42 prior to impact with the road 34.

A more sophisticated shell 30 or 42 is an aluminum can encapsulating the gas and containing microaccelerometers for motion sensing and tied to a sodium azide charge that explodes the cartridge upon impact with the ground. An 8 oz can, two-thirds the size of a standard aluminum soda can contains one pound of fire suppressant, the electronics, and the release mechanism. The end of the can would be scored to allow easy opening upon detonating the sodium azide charge. The microaccelerometer would be a single ADXL05 chip aligned along the cylindrical axis of the can which may also be the direction of travel when thrown or dropped.

Another deployment is the laying of a cartridge on the road 34 in the path of the vehicle 38. The cartridge, an 8 oz aluminum can, could be remotely exploded by radio sensing. The cartridge would be similar in design to the thrown shell 30 or 42 described above, but the ADXL05 would be replaced by one of several commercially available chipsets using the industrial, scientific and medical band (ISM) at 2400 MHz. These chipsets use spread spectrum transmission for noise reduction and to eliminate false triggering. The cartridge will resemble a shortened soda can. This will provide a degree of camouflage for the device since empty and partially crushed soda cans are commonplace on roadways.

The cartridge can alternatively be in a shape such as a long cylinder such that upon explosion, the gas cloud forms a shape reflective of the shape of the cartridge. In this manner, particular shapes of cloud for more effective gas intake by the target vehicle can be used.

Another deployment of the gas is by a launched shell using a launching device to allow more accurate distal targeting. In the case of an aluminum shell with a microaccelerometer, the launching device would project the shell at relatively low muzzle velocity for example, 150 ft/sec, so as to not prematurely trigger the rupturing mechanism, yet provide the shell with sufficient momentum to accurately reach the target site for example, 700 ft away, and there rupture in advance of the moving vehicle.

The shell could be further modified as a needle point charged cartridge suitable for firing from high power launch device. The charge cartridge encapsulating the gas has a bullet shape for stream line flight after firing from the launch device. The charge could have explosive end caps which explode upon impact to the ensure dispersal of the gas upon impact.

Another deployment is the hanging of a shell from an overpass by a tether long enough to suspend the shell about one meter off the road in the path of a fleeing vehicle so that the fleeing vehicle will strike the shell causing rupture and suppression of engine ignition. The shell could also be radio controlled to rupture upon sensing a radio control signal. When dropped to the end of its tether, the shell ruptures upon sensing a radio control signal.

Yet another deployment, could be use of hood piercing shell of fire suppressant. The front of the shell should be a hollow tube and shell would be fired with enough velocity to pierce the thin metal of an automobile hood. The front of the shell expands and anchors to the hood. The shell immediately delivers a charge of fire suppressant through the tube to the engine compartment sufficient to prevent combustion. A preferred charge is one quarter pound of 3% trifluoroidomethane. The internal combustion engine draws air from the small space under the hood requiring less of the gas than a gas cloud. A three pound hood piercing shell could bleed out slowly to provide enough retardant gas to continuously inhibit combustion for a minute. This direct insertion of fire suppressant gas into the engine hood compartment would use the suppressant gas more efficiently and provide the longest lasting effect for a given charge. The shell could be fired from an elevated position.

The above embodiments use of a halon gas is used for suppressing engine ignition. Those skilled in the art can make enhancements, improvements and modifications to the preferred embodiments. However, those enhancements, improvements and modifications may nonetheless fall within the spirit and scope of the following claims.

What is claimed is:

1. A method of stopping the combustion of an internal combustion engine of a motor vehicle having an intake for intaking air for internal combustion, the method comprises the steps of, providing a mixture of a halon suppressant gas consisting of trifluoroiodomethane mixed with an inert atmospheric buoyant gas, forming opposing barricades on opposing sides of the road, the barricades functioning to funnel vehicular traffic between the opposing barricades, placing nozzles in the opposing barricades for releasing the mixture onto the road between the barricades, connecting the container to the nozzles, containing the mixture in a container, positioning the container proximal to a road, and releasing the mixture from the container proximal to the road in front of the intake when the road is traveled by the vehicle for suppressing the combustion of the engine.

2. The method of claim 1 wherein, the mixture contains at least 13% trifluoroidomethane such that one pound of the mixture will create a two meter gas cloud dispersed to a 3% concentration of trifluoroidomethane.

* * * * *